US007435314B2

(12) United States Patent
Hardt et al.

(10) Patent No.: US 7,435,314 B2
(45) Date of Patent: Oct. 14, 2008

(54) METHOD FOR THE PRODUCTION OF A FIBROUS WEB

(75) Inventors: Niels Hardt, Heidenheim (DE); Michael Schwarz, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 479 days.

(21) Appl. No.: 10/980,390

(22) Filed: Nov. 3, 2004

(65) Prior Publication Data

US 2006/0095154 A1 May 4, 2006

(30) Foreign Application Priority Data

Nov. 6, 2003 (DE) ..... 103 51 771

(51) Int. Cl.
*D21F 13/00* (2006.01)

(52) U.S. Cl. ..... 162/198; 162/190; 162/258; 162/263; 162/DIG. 11; 700/127; 700/128; 700/129

(58) Field of Classification Search ..... 162/198, 162/190, 258, 259, 263, DIG. 6, DIG. 11; 700/127, 128, 129
See application file for complete search history.

(56) References Cited

U.S. PATENT DOCUMENTS 6,319,362 B1 11/2001 Huhtelin et al. ..... 162/198

FOREIGN PATENT DOCUMENTS

WO 2004/072367 8/2004

OTHER PUBLICATIONS

Dr. Micheal Schwarz, "Automation", Published in papierausösterreich, (paper of Austria) Oct. 2003, p. 16-18.

*Primary Examiner*—Mark Halpern
(74) *Attorney, Agent, or Firm*—Taylor & Aust, P.C.

(57) ABSTRACT

In a method for the production of a fibrous web, especially a paper or cardboard web, an automatic ash control system and an automatic retention control system for the reduction or suppression of an interactive build-up of the two controls are linked via a model for the dependence between the filler addition and the retention agent consumption. A computer assisted quality control system is also cited.

6 Claims, 3 Drawing Sheets

METHOD FOR THE PRODUCTION OF A FIBROUS WEB

BACKGROUND OF THE INVENTION

1. Field of the Invention

The present invention relates to a method for the production of a fibrous web, especially a paper and/or cardboard web, as well as to a computer supported quality control system that is suitable for the implementation of the method.

2. Description of the Related Art

There are a multitude of MD quality controls, i.e longitudinal profile adjustments for certain quality parameters of the material web (MD=machine direction). To be considered among these are the retention control/and the control of ash content. The retention control is currently only implemented as a stand-alone solution. Interaction between the retention control and other adjustments are, therefore, not a consideration. However, it has been demonstrated that, in the case of the ash control this can result in an interactive build up of the controls.

In an article "Wet End Controller™ ensures stability prior to the head box" by Dr. M. Schwarz which, among other issues, addresses the reciprocal effects between retention and ash content, a combination of ash control, retention control and on-line balances are recommended.

What is needed in the art is a method for the production of a fibrous web, as well as the computer assisted quality control system, which provides for interaction between the retention controls and ash controls.

SUMMARY OF THE INVENTION

The present invention provides an automatic ash control system and an automatic retention control system for the reduction or suppression of an interactive build-up of the two controls.

The invention comprises, in one form thereof, a method for the production of a fibrous web, especially a paper and/or cardboard web, in which an automatic ash control and an automatic retention control are appropriately linked through a model for the dependence between the filler addition and the average retention agent consumption, in order to suppress the interactive build up of the two controls.

Due to this solution a reliable way is provided to avoid interactive build up of the two controls, thus improving the consistency of quality of the finished fibrous web or the finished paper accordingly. In addition, the product quality change-over times are reduced since the number of control circuits working independently from each other is at least reduced and the previously long control distances are avoided. In addition to achieving a faster product quality change-over, a more stable machinery operation is also achieved.

In accordance with a preferred practical version of the presently inventive method the amount of retention agent is increased or reduced with each increase or reduction of the filler volume, according to the model for the dependence between the filler addition and the retention agent consumption. A mathematical model is preferred for the dependence between the filler addition and the retention agent consumption. Through the model for the dependence between the filler addition and the retention agent consumption, an interactive build up of the ash control and the retention control can be especially predictably countered.

An additional preferred design version is characterized in that a concentration measurement in the wire water and/or an ash content measurement, or a measurement of the ash addition volume is at least occasionally used to adjust the model to possible new situations. Therefore, a self-learning system is also especially feasible. This also denotes that as an option signal lines can be connected from the corresponding sensors to the model computing device.

According to the present invention, a computer assisted quality control system in a paper machine having an automatic ash control and an automatic retention control which are linked through a model for the dependence between the filler addition and the average retention agent consumption, in order to suppress the interactive build up of these two controls.

In a preferred practical version of the inventive quality control system the volume of retention agent can be increased or reduced with each increase or reduction of the filler volume according to the model for the dependence between the filler addition and the retention agent consumption.

Preferably, a mathematical model is again preferred for the model of the dependence between the filler addition and the retention agent consumption. The quality control system can for example be designed so that an interactive build-up of the ash control and the retention control can be predictably countered through the model for the dependence between the filler addition and the retention agent consumption.

In another embodiment it is also advantageous where at least one sensor is connected or can be connected to the model computing device, through which preferably a concentration measurement in the wire water and/or an ash content measurement or a measurement of the ash addition volume can be conducted for an at least occasional adjustment of the model to possible new situations.

The appropriate linkage between the automatic ash control and the automatic retention control can be realized especially through appropriate programming of the computer assisted quality control system, and for example through the provision of stored linkage tables, etc. An automatic matching of the model that is the basis for the linkage, to any given operational condition is, for example, also feasible.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification not to be construed as limiting the scope of the invention in any manner.

DETAILED DESCRIPTION OF THE INVENTION

Figure 1:
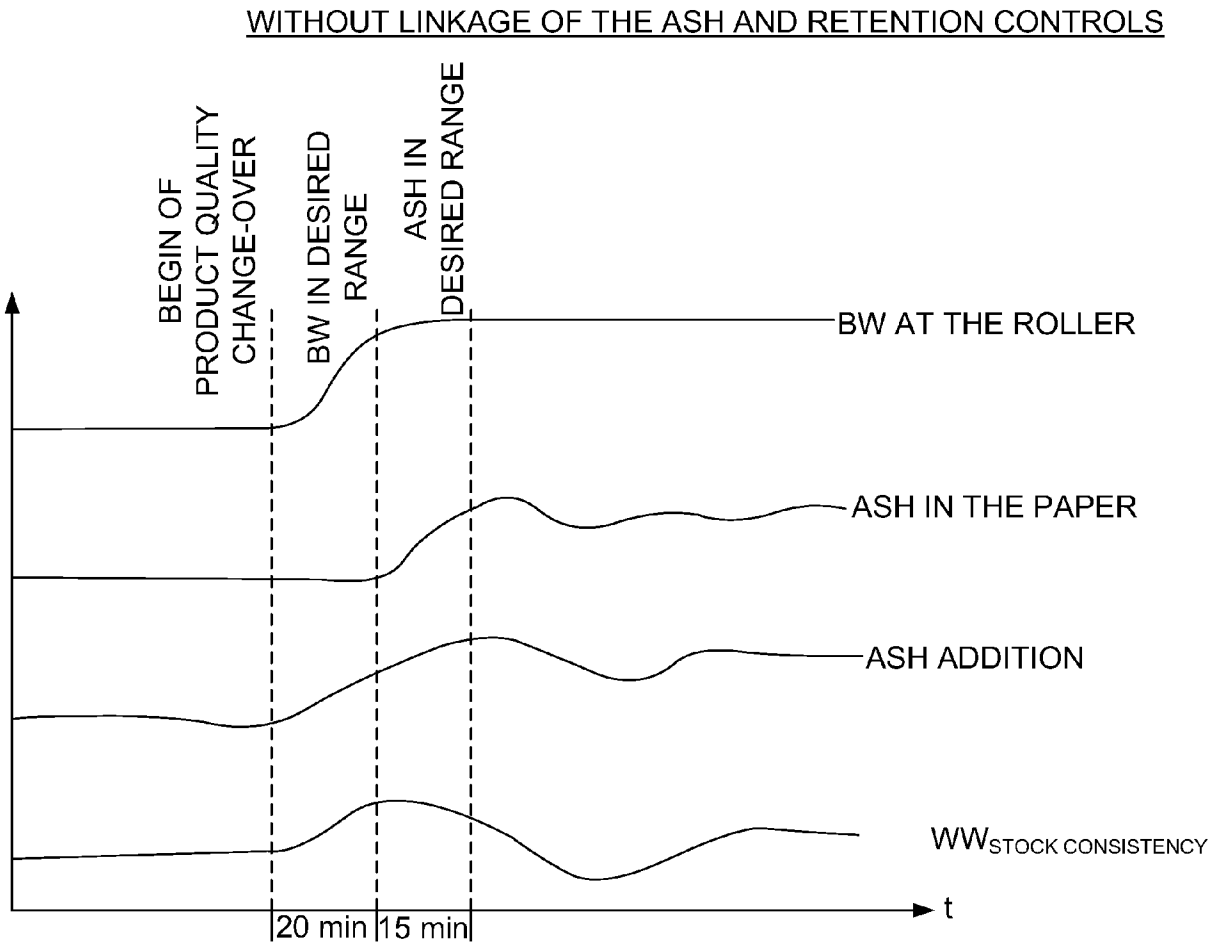
FIG. 1 is a schematic view which illustrates a product quality change without the inventive combination of the ash control and the retention control.
Figure 2:
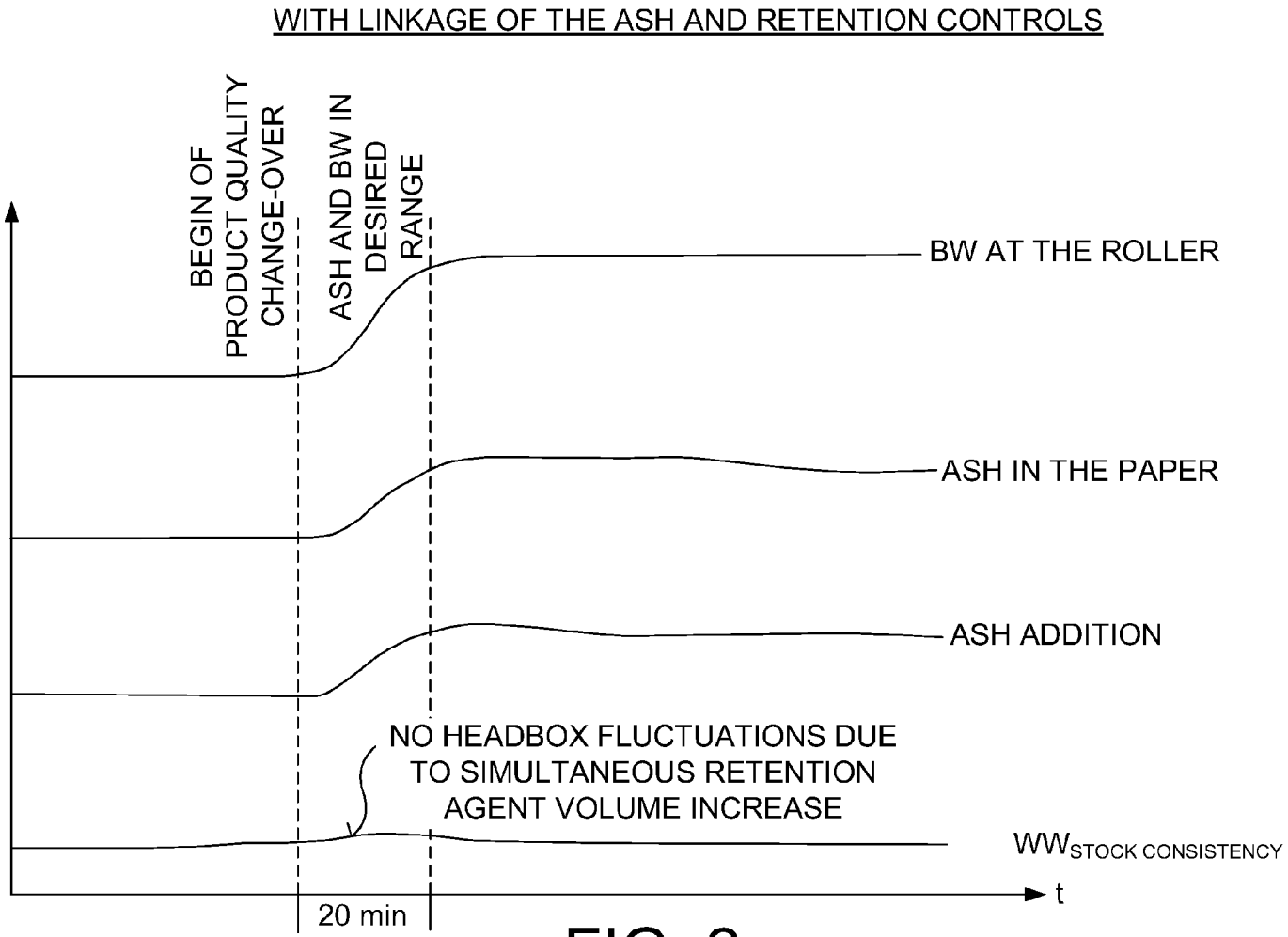
FIG. 2 is a schematic view which illustrates a product quality change with of an embodiment of the present invention which includes inventive ash and retention control.

Referring now to the drawings, and more particularly to FIGS. 1 and 2, the following values are applied over the time t: "BW on the roller" (BW=basis weight), "Ash on the paper", "ash addition" and "$WW_{stock\ consistency}$" (WW=wire water).

FIG. 1 illustrates the chronological progression of the cited values for a product quality change without the inventive combination of the ash and retention control, while FIG. 2 shows the chronological progression of these values for a product quality change with the inventive combined ash and retention control.

As can be seen in FIG. 1 the basis weight (BW) at the roller is already in the desired range after about 20 minutes from the start of the product quality change, while the value "ash in the paper" reaches the desired range only after approximately 15 additional minutes, that is approximately 35 minutes after the start of the product quality change. In addition, the stock consistency in the wire water ($WW_{stock\ consistency}$) shows clear fluctuations.

In contrast the value "ash in the paper" in the example with the inventively linked ash and retention control (see FIG. 2) is also in the desired range as soon as approximately 20 minutes after the start of the product quality change. The values "BW at the roller" and "ash in the paper" reach the desired value at approximately the same time in the present example, approximately 20 minutes after the beginning of product quality change. It can also be seen in FIG. 2 that, due to the inventive linkage of the ash and retention control, or based on the simultaneous increase in the retention agent volume there are practically no fluctuations in the value "$WW_{stock\ density}$", or no more head box fluctuations.

Figure 3:
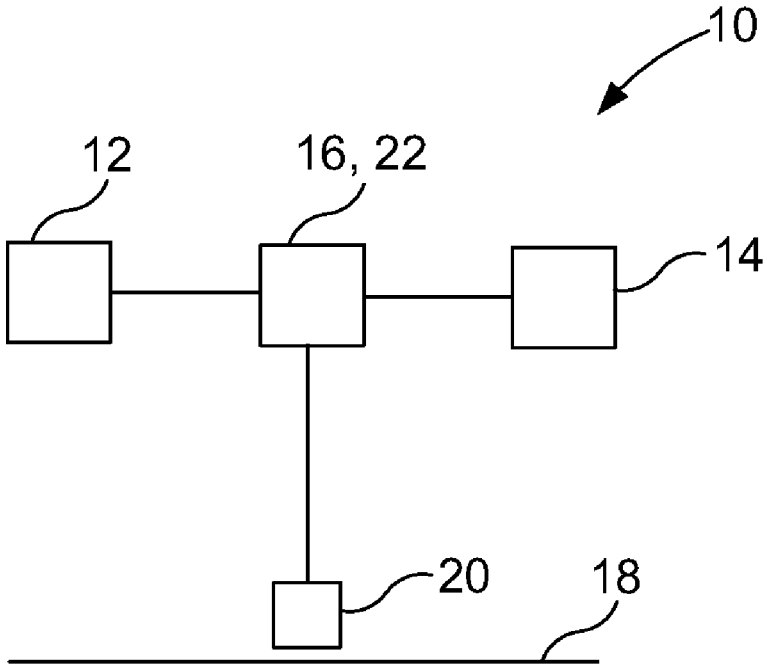
FIG. 3 is a schematic view of an embodiment of a computer assisted quality control system according to the present invention.

FIG. 3 illustrates an embodiment of a computer assisted quality control system 10 in a paper machine which includes an automatic ash control system 12, an automatic retention control system 14 and a model 16 for a dependence between a filler addition and an average retention agent consumption, relative to a fibrous web 18 which may be a paper or cardboard web. Automatic ash control system 12 is linked to automatic retention control system 14 through model 16 to suppress an interactive build up of said automatic ash control system and said automatic retention control system. At least one sensor 20 is connected to a model computing device 22 for at least occasional adjustment of model 16 to a plurality of possible new situations through which at least one of a concentration measurement in a wire water, an ash content measurement and an ash addition volume measurement is conducted, relative to a fibrous web 18.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for the production of a fibrous web, comprising the steps of:

linking an automatic ash control and an automatic retention control through a model for a dependence between a filler addition and an average retention agent consumption; and suppressing an interactive build up of said automatic ash control and said automatic retention control using said model;

changing an amount of said retention agent with each changing of a filler volume according to said model for said dependence between said filler addition and said retention agent consumption.

2. The method of claim 1, wherein said fibrous web is at least one of a paper web and a cardboard web.

3. The method of claim 1, further including the step of utilizing a mathematical model for said dependence between said filler addition and said retention agent consumption.

4. The method of claim 1, further including the step of predictably countering an interactive build up of said automatic ash control and said automatic retention control through said model for said dependence between said filler addition and said retention agent consumption.

5. The method of claim 1, further including the steps of measuring at least one of a concentration measurement in a wire water, an ash content measurement and an ash addition volume measurement, and using at least occasionally a result from said measuring step to adjust said model.

6. The method of claim 1, further including the steps of measuring an ash addition volume, and using at least occasionally a result from said measuring step to adjust said model.

* * * * *